US010723671B2

(12) United States Patent
Fan et al.

(10) Patent No.: US 10,723,671 B2
(45) Date of Patent: Jul. 28, 2020

(54) METHOD FOR THE PREPARATION OF UNIFORM TRIAMINOTRINITROBENZENE MICROPARTICLES

(71) Applicant: National Technology & Engineering Solutions of Sandia, LLC, Albuquerque, NM (US)

(72) Inventors: Hongyou Fan, Albuquerque, NM (US); Kaifu Bian, Beaverton, OR (US); David Rosenberg, Albuquerque, NM (US); Leanne Julia Alarid, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 267 days.

(21) Appl. No.: 16/043,800

(22) Filed: Jul. 24, 2018

(65) Prior Publication Data

US 2019/0039967 A1 Feb. 7, 2019

Related U.S. Application Data

(60) Provisional application No. 62/540,840, filed on Aug. 3, 2017, provisional application No. 62/656,716, filed on Apr. 12, 2018.

(51) Int. Cl.

| | |
|---|---|
| ***D03D 23/00*** | (2006.01) |
| ***D03D 43/00*** | (2006.01) |
| ***C06B 25/04*** | (2006.01) |
| ***C06B 45/22*** | (2006.01) |
| ***C06B 21/00*** | (2006.01) |
| ***C06B 45/02*** | (2006.01) |
| *C06B 25/00* | (2006.01) |

(52) U.S. Cl.
CPC ..... *C06B 45/22* (2013.01); *C06B 21/0033* (2013.01); *C06B 25/04* (2013.01); *C06B 45/02* (2013.01)

(58) Field of Classification Search
USPC ..... 149/88, 105, 109.4, 109.6
See application file for complete search history.

(56) References Cited

U.S. PATENT DOCUMENTS

2008/0251169 A1* 10/2008 Nicolich ..... C07F 9/54 149/22
2012/0024437 A1* 2/2012 Nicolich ..... C06B 21/005 149/92
2014/0227548 A1* 8/2014 Myrick ..... C10L 1/28 428/570

OTHER PUBLICATIONS

Ghosh, M. et al., "Probing Crystal Growth of ϵ- and α-CL-20 Polymorphs via Metastable Phase Transition Using Microscopy and Vibrational Spectroscopy", Crystal Growth & Design, 2014, pp. 5053-5063, vol. 14.

(Continued)

*Primary Examiner* — James E McDonough
(74) *Attorney, Agent, or Firm* — Kevin W. Bieg

(57) ABSTRACT

A new, rapid and inexpensive synthesis method for monodispersed triaminotrinitrobenzene (TATB) microparticles based on micelle-confined precipitation that enables control of microscopic morphology. The morphology of the TATB microparticles can be tuned between quasi-spherical and faceted by controlling the speed of recrystallization. The method enables improved performance and production consistency of TATB explosives for military grade explosives and propellants

12 Claims, 5 Drawing Sheets

(56) References Cited

OTHER PUBLICATIONS

Firsich, D.W. et al., "TATB Purification and Particle Size Modification: An Evaluation of Processing Options", Mound Laboratory, 1990, Miamisburgh, OH.
Yang, G. et al., "Preparation and Characterization of Nano-TATB Explosive", Propellants, Explosives, Pyrotechnics, 2006, pp. 390-394, vol. 31.
Han, T.Y. et al., "The Solubility and Recrystallization of 1,3,5-triamino-2,4,6-Trinitrobenzene in a 3-Ethyl-1-Methylimidazolium Acetate-DMSO Co-Solvent System", New Journal of Chemistry, 2009, pp. 50-56, vol. 33.
Foltz, M.F. et al., "Recrystallization and Solubility of 1,3,5-Triamino-2,4,6-Trinitrobenzene in Dimethyl Sulfoxide", Journal of Materials Science, 1996, pp. 1893-1901, vol. 31.
Talawar, M.B. et al., "Method for Preparation of Fine TATB (2-5 μm) and its Evaluation in Plastic Bonded Explosive (PBX) Formulations", Journal of Hazardous Materials, 2006, pp. 1848-1852, vol. B137.
Yang, L. et al., "Preparation of Ultrafine TATB and the Technology for Crystal Morphology Control", Chinese Journal of Chemistry, 2012, pp. 293-298., vol. 30.
Tan, X. et al., "Preparation of Nano-TATB by Semibatch Reaction Crystallization", Nano: Brief Reports and Reviews, 2013, 1350055, vol. 8, 8 pages.
Bai, F. et al., "Porous One-Dimensional Nanostructures through Confined Cooperative Self-Assembly", Nano Letters, 2011, pp. 5196-5200, vol. 11.
Zhong, Y. et al., "Interfacial Self-Assembly Driven Formation of Hierarchically Structured Nanocrystals with Photocatalytic Activity", ACS Nano, 2014, pp. 827-833, vol. 8.

* cited by examiner

METHOD FOR THE PREPARATION OF UNIFORM TRIAMINOTRINITROBENZENE MICROPARTICLES

CROSS-REFERENCE TO RELATED APPLICATIONS

This application claims the benefit of U.S. Provisional Application No. 62/540,840, filed Aug. 3, 2017, and U.S. Provisional Application No. 62/656,716, filed Apr. 12, 2018, both of which are incorporated herein by reference.

STATEMENT OF GOVERNMENT INTEREST

This invention was made with Government support under Contract No. DE-NA0003525 awarded by the United States Department of Energy/National Nuclear Security Administration. The Government has certain rights in the invention.

FIELD OF THE INVENTION

The present invention relates to energetic materials and, in particular, to a method for the preparation of triaminotrinitrobenzene microparticles with controlled morphology.

BACKGROUND OF THE INVENTION

Consistent and optimized sensitivity and energy density of energetic materials are essential to their performance and safety in applications such as explosives and propellants. These factors heavily rely on the microscopic morphology of energetic materials including crystalline size, shape, uniformity and purity. See M. Ghosh et al., *Cryst. Growth Des.* 14, 5053 (2014). Triaminotrinitrobenzene (TATB) is a powerful energetic material which displays superior insensitivity to elements such as shock, impact, vibration or fire over any other known energetic material. See S. F. Rice and R. L. Simpson, *The Unusual Stability of TATB: A Review of the Scientific Literature*, Lawrence Livermore National Laboratory, Livermore, Calif. (1990). This insensitivity makes TATB the best choice where absolute safety is required. See B. M. Dobratz, *The Insensitive High Explosive Triaminotrinitrobenzene (TATB): Development and Characterization*, Los Alamos Scientific Laboratory, Los Alamos, N M (1995); W. E. Voreck et al., U.S. Pat. No. 5,597,974 A (28 Jan. 1997); and R. Thorpe and W. R. Feairheller, *Development of Processes for Reliable Detonator Grade Very Fine Secondary Explosive Powders*, Monsanto Research Corporation, Miamisburg, Ohio (1988). However, TATB particles prepared by existing methods typically lack uniformity in crystalline morphology. Such irregularity limits the potential to produce TATB with reproducible and predictable performance. Further, the sharp edges of existing energetic material particles result in detonation hot spots which are responsible for reducing energetic material stability. See M. Ghosh et al., *Cryst. Growth Des.* 14, 5053 (2014).

Therefore, a need remains for TATB microparticles with uniform particle size and spherical shape.

SUMMARY OF THE INVENTION

The present invention is directed to an inexpensive and rapid synthesis for monodispersed TATB microparticles based on recrystallization of TATB within ionic liquid micelles. The method comprises providing a first solution comprising triaminotrinitrobenzene dissolved in an ionic liquid, such as 1-butyl-3-methylimidazolium; providing a second solution comprising a nonionic surfactant and a solvent that is immiscible in and has a high polarity contrast against the ionic liquid, such as octane; mixing the first and the second solutions while being sonicated to form an emulsion comprising micelles of the first solution dispersed in the solvent; and adding an anti-solvent precipitant to the emulsion to precipitate microparticles of triaminotrinitrobenzene in the micelles. The microparticles can then be separated from the micelles, for example by centrifugation. The choice of a surfactant with proper hydrophilic-lipophilic balance value is important to micelle formation and therefore successful microparticle production. Therefore, the nonionic surfactant can have hydrophilic-lipophilic balance (HLB) value between 3-8, such as sorbitan ester, ethoxylated sorbitan ester, or polyethylene glycol alkyl ether. Depending on recrystallization speed of TATB, different microparticle morphologies of either quasi-spherical or faceted can be obtained. For example, if the anti-solvent precipitant is water, quasi-spherical microparticles are formed. If the anti-solvent precipitant is an alcohol, faceted microparticles are formed. Due to their desirable size and morphology, these TATB microparticles show even greater insensitivity and improved reproducibility and reliability of explosive devices than currently available TATB products.

BRIEF DESCRIPTION OF THE DRAWINGS

The detailed description will refer to the following drawings, wherein like elements are referred to by like numbers.

DETAILED DESCRIPTION OF THE INVENTION

Efforts to achieve TATB products with uniform particle size and spherical shape have been reported. See D. W. Firsich et al., *TATB Purification and Particle Size Modification: An Evaluation of Processing Options*, Mound Laboratory, Miamisburg, O H (1990); G. Yang et al., *Propellants Explos. Pyrotech.* 31, 390 (2006); T. Y. Han et al., *New J. Chem.* 33, 50 (2009); M. Foltz et al., *J. Mater. Sci.* 31, 1893 (1996); M. B. Talawar et al., *J. Hazard. Mater.* 137, 1848 (2006); L. Yang et al., *Chin. J. Chem.* 30, 293 (2012); and X. Tan et al., *Nano* 8, 573 (2013). These methods are mainly based on variations of recrystallization of TATB from its solution in concentrated sulfuric acid or dimethyl sulfoxide. The resultant TATB particles display only limited yield and improvement on quality compared with raw material from industrial suppliers. Additionally, the use of concentrated sulfuric acid significantly increases the cost of equipment and imposes potential danger to operators.

Figure 1:
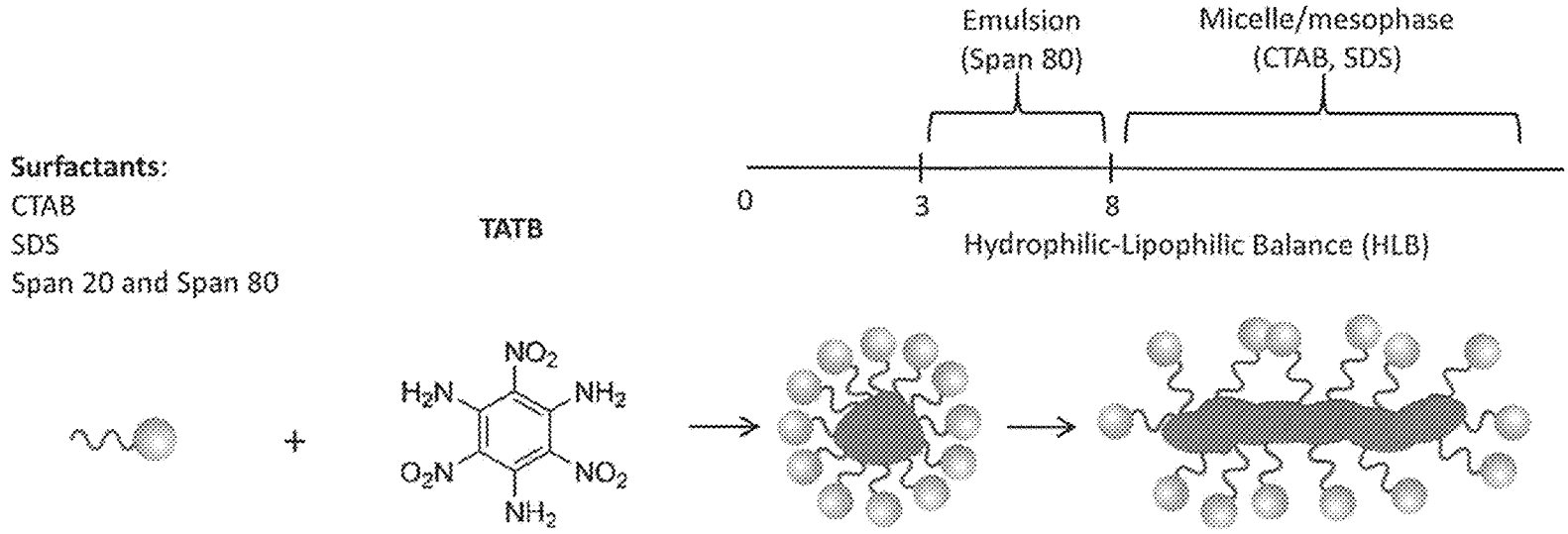
FIG. 1 is a schematic illustration of a surfactant-assisted cooperative self-assembly (micelle/emulsion) method to reprocess energetic materials and control their morphologies.

FIG. 1 is a schematic illustration of a generalized surfactant-assisted cooperative self-assembly (micelle/emulsion) method to reprocess energetic materials and control their morphologies. The energetic material microparticle growth method is modified from a micelle-confinement method which was previously developed to synthesize a variety of molecular crystalline particles. See F. Bai et al., *Nano Lett.* 11, 5196 (2011); and Y. Zhong et al., *ACS Nano* 8, 827 (2014). Common energetic materials that can be used with this general method include but not limited to hexanitrostilbene (HNS), hexanitrohexaazaisowurtzitane (CL-20), cyclotetramethylene-tetranitramine (HMX), and triaminotrinitrobenzene (TATB). Any surfactants with an hydrophilic-lipophilic balance (HLB) value between 3-8, such as sorbitan ester, ethoxylated sorbitan ester, and polyethylene glycol alkyl ether, can be used to form the emulsion. For example, Span 20 (sorbitan monolaurate) and Span 80 (sorbitan monoleate) are inexpensive non-ionic surfactants widely used in the food, medicine, and beauty industries (Span® 20 and Span® 80 are registered trademarks of Corda International PLC). These amphiphilic surfactants consist of a molecule that combines both hydrophilic (water-loving or polar) and lipophilic (oil-loving or non-polar) groups. The HLB of the surfactant expresses the balance of the size and strength of the hydrophilic and the lipophilic groups. A surfactant that is lipophilic in character has a low HLB number, and one that is hydrophilic has a high HLB number. The HLB is preferably between 3-8 for a nonionic surfactant to form a good emulsion. Therefore, the Span surfactants that have an HLB between 3 and 8 are suitable for the microparticle synthesis, whereas the cetyltrimethylammonium bromide (CTAB) and sodium dodecyl sulfate (SDS) surfactants have an HLB greater than 8 are not.

The present invention is directed to a micelle-assisted synthesis of monodispersed TATB microparticles using an ionic solvent and a nonionic surfactant. As described above, the choice of the surfactant with proper HLB value is a key to successful microparticle production. Depending on recrystallization speed of TATB, different morphologies of either quasi-spherical or faceted microparticles can be obtained. Due to their desirable size and morphology, these TATB microparticles are expected to show even greater insensitivity and improved reproducibility and reliability of explosive devices than currently available TATB products.

Figure 2:
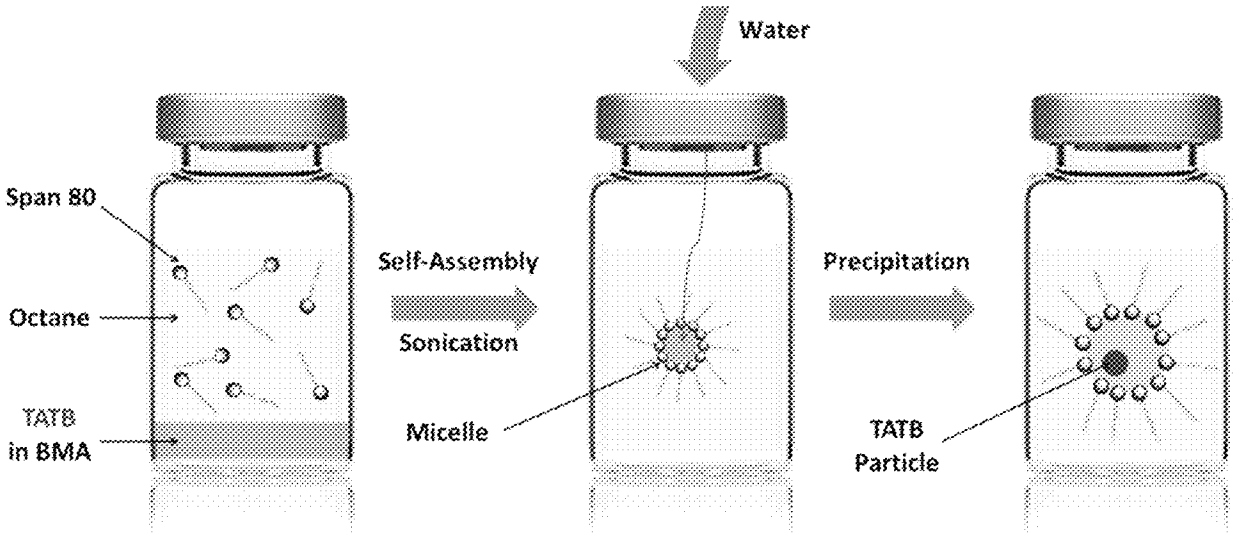
FIG. 2 is a schematic illustration of the growth process of TATB microparticles according to the micelle-confinement method of the present invention.

An exemplary method to form TATB microparticles is illustrated in FIG. 2. TATB is first dissolved in 1-Butyl-3-methylimidazolium acetate (BMA) ionic liquid. Ionic liquid is chosen as the carrier solvent to achieve practical TATB solubility, high polarity contrast against octane, and moderate operation conditions. In an exemplary synthesis, 10 mg TATB powder was first dissolved in 400 μL BMA ionic liquid by heating the mixture to 110° C. for about 15 mins. In a separate 20 mL glass vial, Span 80 surfactant was added into 10 mL octane to obtain a 10 mM solution. 100 μL of the TATB-BMA solution was then injected into the Span 80 solution while being sonicated. An opaque and milky solution was obtained instantly, indicating the formation of micelles encapsulating TATB/BMA. In earlier studies for particle synthesis of other materials, particle formation was triggered by evaporating the carrier solvents by either heat or vacuum. However, due to the high boiling point of the ionic liquid, TATB particle precipitation within micelles was achieved by adding water as an anti-solvent precipitant into the emulsion. Water is quickly introduced into the micelles due to strong attraction from the ionic liquid. It drives the oversaturation and rapid precipitation of TATB, which is insoluble in water, within the micelles. In the above example, to precipitate TATB and form microparticles, 5 mL of water was added dropwise, with continuous sonication, to reduce the solubility of TATB in the micelles. The mixture became a homogeneously cloudy suspension indicating precipitation of TATB microparticles. Finally, the raw product was separated by centrifugation to keep the yellow precipitate which was then cleaned by hexane and ethanol to remove any residual solvent, surfactant and ionic liquid. The final product was dispersed in a small amount of ethanol for storage and further characterization.

Figures 3A, 3B, 3C:
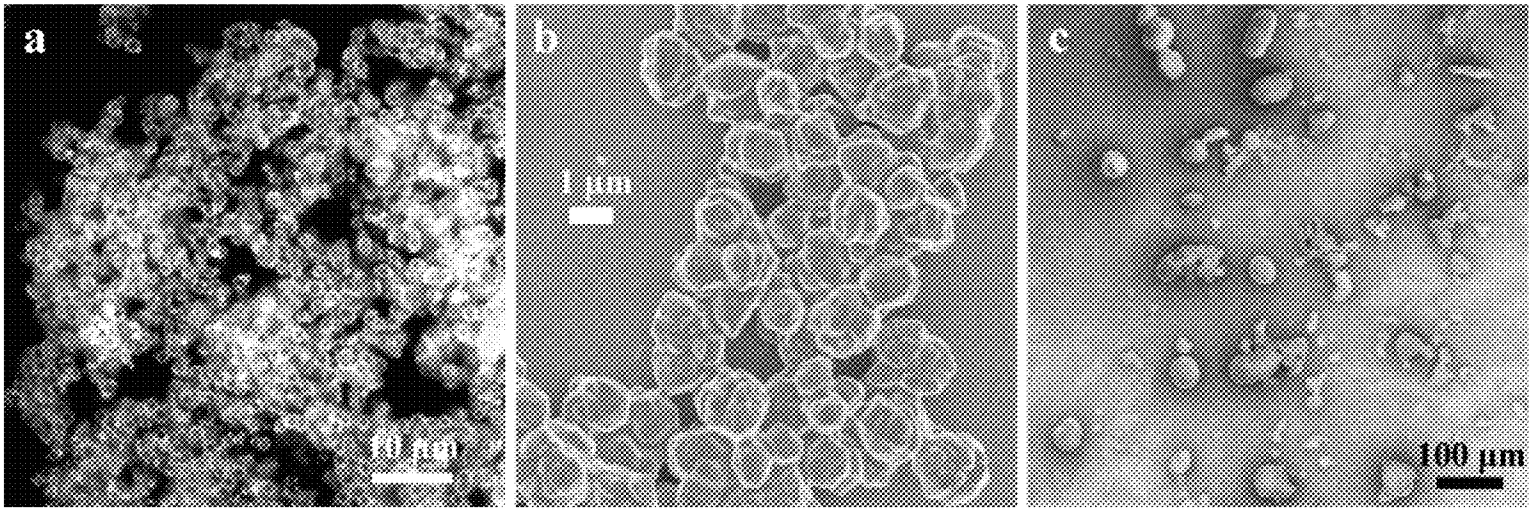
FIG. 3A is an optical micrograph of the yellow TATB microparticles produced by the micelle-confinement method.
FIG. 3B is a scanning electron microscope (SEM) image of TATB microparticles.
FIG. 3C is an SEM image of as-received TATB powder.

As shown in FIG. 3A, optical microscopy of the product revealed uniform microparticles having a yellow color, indicating TATB. The higher resolution SEM image in FIG. 3B confirmed a quasi-spherical morphology of the TATB microparticles. Statistically these microparticles averaged a diameter of 1.48 μm with standard deviation of only 0.14 μm (9.5%). This monodispersity is a dramatic improvement over the raw TATB powder, which contained particles of tens of microns with broad size distribution, as shown in FIG. 3C. The quasi-spherical, uniform TATB microparticles can provide improved performance and reproducibility of explosive devices. In addition, these TATB microparticles can enhance energetic material stability by not showing faceted features or sharp edges.

Figure 4:
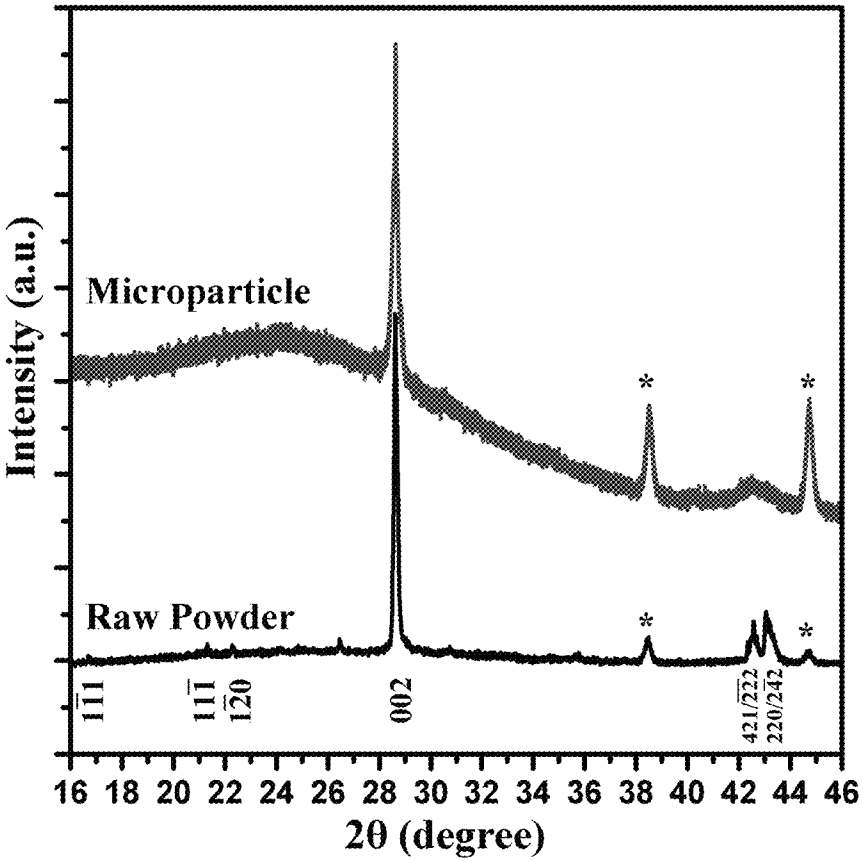
FIG. 4 shows X-ray diffraction (XRD) patterns of TATB raw powder and microparticles. The peaks are identified and labeled with their Miller indices. The two peaks marked by asterisks were from the aluminum sample holder of the XRD instrument.

The product microparticles were examined by powder X-ray diffraction (XRD) measurements to confirm their composition. In FIG. 4 is shown a XRD pattern of the microparticles. By comparing the XRD pattern from the microparticles with that from raw material TATB, it was found that the microparticles are in good agreement with the triclinic TATB crystal structure (space group P-1) with lattice parameters of a=9.01, b=9.03, c=6.81 Å and $\alpha$=108.6°, $\beta$=91.8°, $\gamma$=120.0°. See H. Cady and A. Larson, *Acta Cryst.* 18, 485 (1965). In this lattice, the hexagonal disk-like TATB molecules form robust monolayers in the a-b plane via strong hydrogen bonds between their nitro and amine groups. The monolayers then pile up in c direction, forming the triclinic lattice. See H. Zhang et al., *AIP Adv.* 3, 092101 (2013); and G. Filippini and A. Gavezzotti, *Chem. Phys. Lett.* 231, 86 (1994). The diffraction from the microparticles displayed noticeably weakened and broadened peaks with respect to the bulk material. This is a result of reduced crystalline size and lattice ordering, consistent with the micron-sized quasi-spherical particle shape with little faceted features.

Figure 5A:
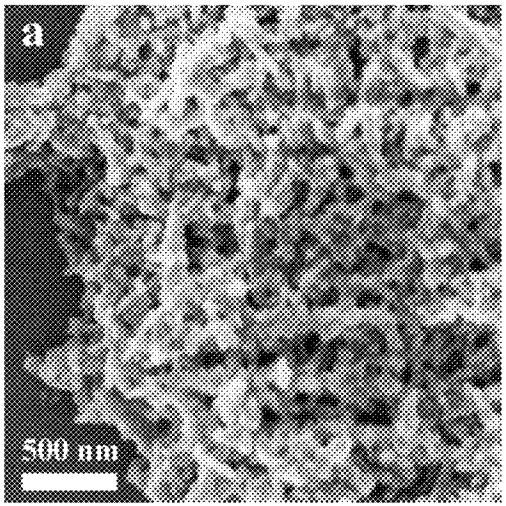
FIG. 5A is an SEM image of the TATB product from a control experiment without surfactant.

TATB produced by recrystallization methods have been reported that do not exhibit the monodispersity of microparticles of the present invention. See T. Y. Han et al., *New J. Chem* 33, 50 (2008); M. Foltz et al., *J. Mater. Sci.* 31, 1893 (1996); G. Yang et al., *Propellants Explos. Pyrotech.* 31, 390 (2006); and M. Foltz et al., *J. Mater. Sci.* 31, 1741 (1996). The significantly improved morphology and uniformity of the microparticles are attributed to the surfactant-driven micelle formation. To study the mechanism, a control experiment was conducted under the same conditions except for the absence of surfactant. In this case, large chunks of yellow agglomerates were produced upon addition of water. As can be seen in SEM image shown in FIG. 5A, the agglomerates showed a branched and sponge-like morphology. Interestingly, the sponge structure possessed nanoscale texture which is believed to be caused by the strong shear forces induced by sonication during the recrystallization of TATB. The increased surface area/volume ratio of the sponge TATB could potentially provide improved discharge performance, but its high porosity might limit EM energy density. These significant morphological differences indicate that the presence of surfactant is crucial to the synthesis of the quasi-spherical TATB microparticles.

Figure 5B:
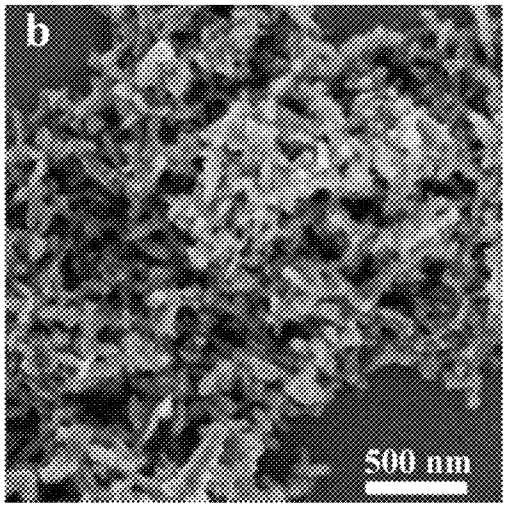
FIG. 5B is an SEM image of the TATB product from a control experiment using sodium dodecyl sulfate (SDS) as the surfactant.

To obtain deeper insights into the role of the Span 80 surfactant and confirm the micelle confinement mechanism, the synthesis was repeated with another common ionic surfactant, SDS. As described above, the hydrophilic-lipophilic balance, or HLB, is a parameter widely used to evaluate and predict the performance of surfactants. See W. Griffin, *J. Soc. Cosm. Chem.* 1, 311 (1949); W. Griffin, *J. Soc. Cosm. Chem.* 5, 249 (1954); and J. Davies, *A quantitative kinetic theory of emulsion type, I. Physical chemistry of the emulsifying agent*, Proceedings of International Congress of Surface Activity, (1957), pp. 426. Surfactants with HLB ranging between about 3 and 8 are ideal emulsifiers for water-in-oil type micelles. Span 80 has a HLB of 4.3 and was predicted to encapsulate the highly polar ionic liquid in the continuous non-polar phase of octane. On the other hand, SDS with a much higher HLB value of 40 is favorable for oil-in-water type emulsions and was not expected to form micelles. As expected, the product shown in FIG. 5B displayed very similar TATB morphology to the no-surfactant case, indicating that SDS did not produce microparticles. This result further confirmed the important role of a carefully chosen surfactant with a proper HLB to promote reliable micelle formation.

Figure 5C:
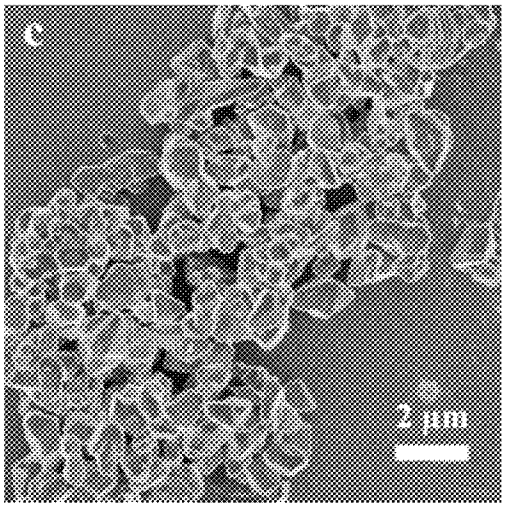
FIG. 5C is an SEM image of the TATB product from a control experiment using sorbitan monoleate (Span 80) as the surfactant and ethanol as the precipitant.

In order to study the relationship between recrystallization speed and the morphology of the TATB microparticles, water was replaced by ethanol as the precipitant. Ethanol is miscible with both BMA and octane. Therefore, with the same injection rate, less precipitant would enter the BMA micelles causing a slower recrystallization process of TATB. As shown by FIG. 5C, ethanol resulted in TATB microparticles of similar micron size but faceted morphology. On one hand, slower recrystallization provides a longer relaxation time for the formation of crystalline particles with better ordering and lower free energy. On the other hand, the rapid recrystallization with water increases the likelihood of incorporating impurities, such as surfactant, into TATB microparticles while reducing the tendency to form faceted features.

The present invention has been described as a method for preparation of TATB microparticles. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A method to synthesize triaminotrinitrobenzene microparticles, comprising:

providing a first solution comprising triaminotrinitrobenzene dissolved in an ionic liquid;

providing a second solution comprising a nonionic surfactant and a solvent that is immiscible in and has a high polarity contrast against the ionic liquid;

mixing the first and the second solutions while being sonicated to form an emulsion comprising micelles of the first solution dispersed in the solvent; and adding an anti-solvent precipitant to the emulsion to precipitate microparticles of triaminotrinitrobenzene in the micelles.

2. The method of claim 1, further comprising separating the microparticles of triaminotrinitrobenzene from the micelles.

3. The method of claim 1, wherein the ionic liquid comprises 1-butyl-3-methylimidazolium acetate.

4. The method of claim 1, wherein the solvent comprises a hydrocarbon.

5. The method of claim 4, wherein the hydrocarbon comprises octane.

6. The method of claim 1, wherein the surfactant has a hydrophilic-lipophilic balance between 3 and 8.

7. The method of claim 1, wherein the surfactant comprises a sorbitan ester, ethoxylated sorbitan ester, or polyethylene glycol alkyl ether.

8. The method of claim 1, wherein the anti-solvent precipitant comprises water.

9. The method of claim 1, wherein the anti-solvent precipitant comprises an alcohol.

10. The method of claim 1, wherein the triaminotrinitrobenzene microparticles are quasi-spherical in shape.

11. The method of claim 1, wherein the triaminotrinitrobenzene microparticles are less than 10 microns in diameter.

12. The method of claim 1, wherein the triaminotrinitrobenzene microparticles have a triclinic crystal structure.

* * * * *